US005379521A

United States Patent [19]

Lynders

[11] Patent Number: 5,379,521

[45] Date of Patent: Jan. 10, 1995

[54] SAFETY SCISSORS

[75] Inventor: Michael J. Lynders, Huntington, Conn.

[73] Assignee: Ed Kaplan Associates, Teaneck, N.J.

[21] Appl. No.: 186,326

[22] Filed: Jan. 25, 1994

[51] Int. Cl.[6] ..... B26B 13/00

[52] U.S. Cl. ..... 30/233; 30/258

[58] Field of Search ..... 30/233, 254, 258, 155

[56] References Cited

U.S. PATENT DOCUMENTS

| | | | |
|---|---|---|---|
| D. 147,416 | 9/1947 | O'Brien | 30/233 X |
| 185,077 | 12/1876 | Coates | 30/233 |
| 681,872 | 9/1901 | Postletwait . | |
| 723,109 | 3/1903 | Willmott | 30/233 |
| 1,279,389 | 9/1918 | Malsin . | |
| 1,284,419 | 11/1918 | Gee . | |
| 1,876,218 | 9/1932 | Ullman, Jr. . | |
| 2,272,753 | 2/1942 | Steinhardt . | |
| 2,557,553 | 6/1951 | Metzger . | |
| 2,591,740 | 4/1952 | Stillwell et al. . | |
| 4,235,016 | 11/1980 | Kobelt . | |
| 4,423,729 | 1/1984 | Gray . | |
| 4,805,305 | 2/1989 | David . | |
| 5,297,342 | 3/1994 | Malone | 30/233 |

FOREIGN PATENT DOCUMENTS

| | | |
|---|---|---|
| 529266 | 11/1940 | United Kingdom . |
| 2163988 | 9/1984 | United Kingdom . |

*Primary Examiner*—Eugenia Jones

*Attorney, Agent, or Firm*—Cowan, Liebowitz & Latman

[57] ABSTRACT

An improved form of safety scissor which prevents potential injury to the user such as that which may result from the insertion of a finger or other body part between the opposing cutting edges thereof, while simultaneously providing a scissor which can be employed in a conventional manner and which allows for the cutting of multiple layers of material, as well as a wide variety of types of materials, including both human hair and synthetic fibrous materials, comprising a pair of scissor blades having opposed cutting edges and operating handles, pivotally connected to one another, and provided with a flat and generally U-shaped shield respectively in a manner which prevents direct contact by the user with the cutting edge or tip of the said cutting blades.

8 Claims, 2 Drawing Sheets

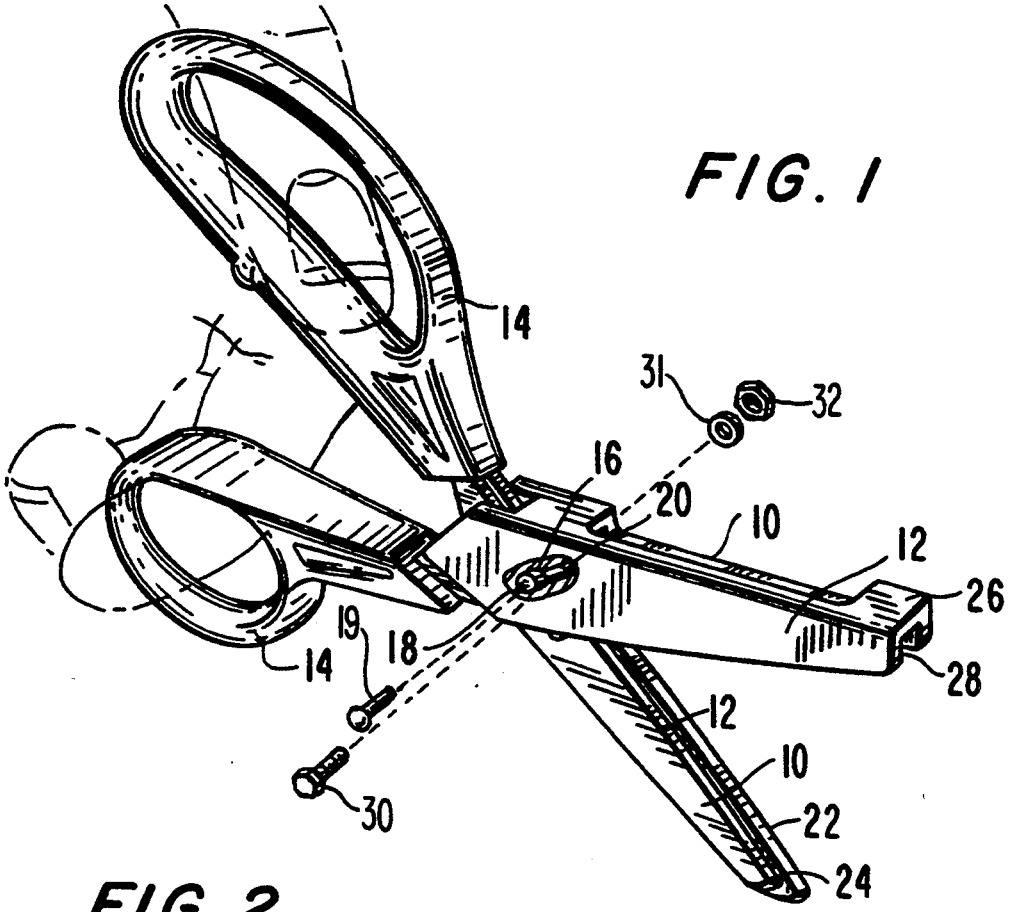
FIG. 1
FIG. 2
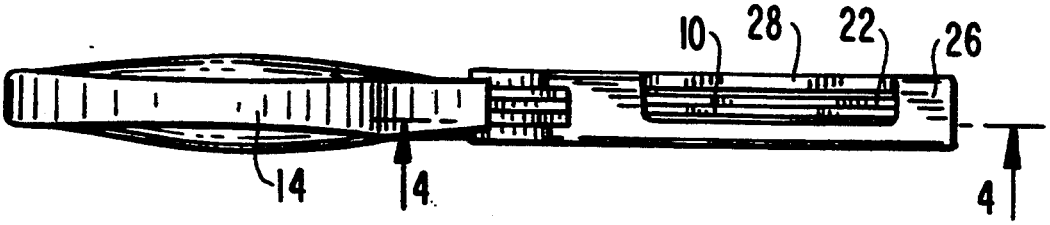
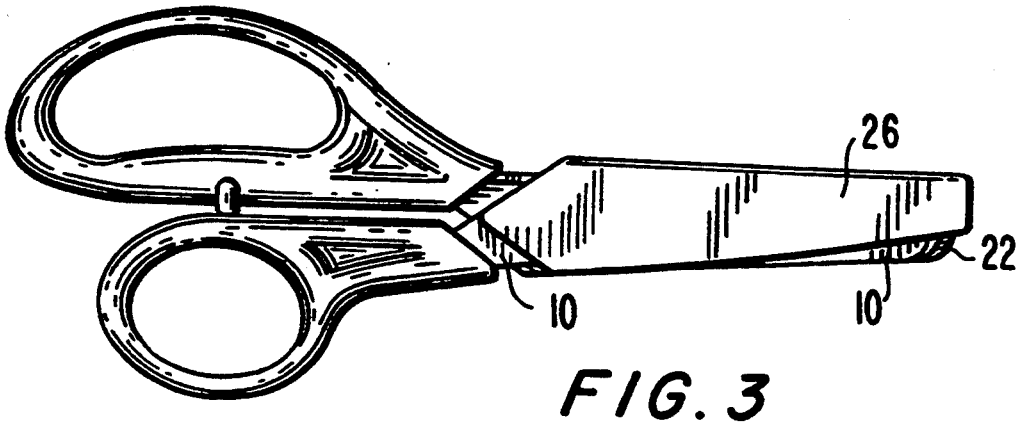
FIG. 3

SAFETY SCISSORS

FIELD OF THE INVENTION

The present invention relates to scissors and more particularly to safety scissors which have been provided with means for recessing the opposing cutting edges of said scissors so as to render the scissors child-proof.

BACKGROUND OF THE INVENTION

A large variety of safety scissors have been developed for use by children and are available in the art.

Many of the available prior art safety scissors employ a narrow slot through which the material to be cut may be inserted by the user, which serves to limit both the application and the thickness of material which may be effectively cut using these types of scissors. Other types of prior art safety scissors provide various forms of shields which limit the user's access to a pointed surface or prevent contact with one or more of the sharp cutting edges of the cutting device provided for.

Generally, the objective of all of the prior art teachings related to child-proof and other types of safety scissors have been, as it is with the present invention, to prevent an immature or unsophisticated user from inserting a finger or other body part into said scissors and doing personal injury to themself or others.

Examples of prior art safety scissors include the following:

U.S. Pat. No. 681,972, which issued to Postlethwait on Sep. 3, 1901, teaches a scissors which have been provided with supplemental jaws that will retain the material to be cut to prevent said material from tearing;

U.S. Pat. No. 1,279,389, which issued to Malsin on Sep. 17, 1918, relates to a safety scissors which has been fitted with a safety guard consisting of a plate which is provided with a longitudinal central recess;

U.S. Pat. No. 1,284,419, which issued to Moody on Nov. 12, 1918, teaches a safety scissors which has been provided with an auxiliary safety device to protect a person from injury when carrying the scissors about in the pocket and for protecting the points of the scissors from damage;

U.S. Pat. No. 1,876,218, which issued to Gee on Sep. 6, 1932, is directed to a scissors useful to operators of full fashioned hosiery machines so as to allow the operator to utilize one hand instead of two to perform the necessary cutting functions required to carry out the knitting operation;

U.S. Pat. No. 1,997,242, which issued to Ullman, Jr. on Apr. 9, 1935, relates to a cutting device having a diagonally arranged opening for receiving the object to be cut and a sliding knife for cutting part of the object;

U.S. Pat. No. 2,272,753, which issued to Steinhardt on Feb. 10, 1942, teaches a safety scissors which is provided with a narrow slot of a fixed width in place of the usual V-opening between the cutting edges of the scissor blades, said slot being sufficiently wide to permit the cutting operation on the material inserted therein but narrow enough to prevent engagement of the users finger with the cutting edges of the scissor blades;

U.S. Pat. No. 2,557,553, which issued to Metzger on Jun. 19, 1951, relates to play scissors especially designed to be used by children which is provided with a guard surrounding one of the scissor blades preventing all but thin sheets of paper from being inserted between the guard and the unprotected scissor blade so as to prevent a child from inserting a finger or the like into the operative portion of the said scissors;

U.S. Pat. No. 2,591,740, which issued to Stilwell et al. on Apr. 8, 1952, concerns a child's safety scissors which is provided with guard plates wherein, in one embodiment, the cutting blade is interposed between two plates which are provided with parallel slots allowing the cutting blade to contact a piece of paper which is inserted therein, without exposing a child to the action of the blade;

U.S. Pat. No. 4,235,016, which issued to Kobelt on Nov. 25, 1980, teaches safety scissors which are provided with a guard member secured at one end adjacent to the pivot point of the scissor blades, the said guard member extending away from the cutting edge at an acute angle and downward to form a narrow slot at the inside edge of the cutting blade thereby forming an open space between the guard member and the cutting edge;

U.S. Pat. No. 4,423,729, which issued to Gray on Jan. 3, 1984, relates to a suture installation instrument wherein the blades of a pair of suture scissors are pivotally mounted within a tapered hood, the said hood being provided with a slot in parallel alignment with the shearing line of the blades of the scissors;

U.S. Pat. No. 4,805,305, which issued to Davis on Feb. 21, 1989, teaches a replaceable razor blade scissor useful in cutting hair which incorporates the feature of providing a cutting surface which consists of a straight edged razor blade which can be replaced when dull;

U.K. Patent Specification 529,266, which issued to Seller, III et al. on Nov. 18, 1940, relates to a scissor in which the blade contacting the work is provided with a guard plate or sheath extending along and projecting beyond the cutting edge of the blade; and U.K. Patent Application No. 2,163,988, which issued to Chan on Sep. 6, 1984, relates to a scissor having a blade which is moveable within a protective casing and provides a defined slot for receiving the material to be cut thus preventing a child's finger from being inserted between the blades.

The present invention differs from any of the known prior art devices in that it teaches a child-proof safety scissor which can be used in the same fashion as a conventional scissor and, therefore, has the broadest possible utility for cutting varying thicknesses of a broad range of materials, including paper fabric and elongated fibrous materials, such as, for example, human or synthetic hair.

DESCRIPTION OF THE DRAWINGS

FIG. 1 is a partially exploded isometric view of the safety scissor arrangement of the present invention showing the opposing scissor blades and their respective safety shields attached;

FIG. 2 is a top view of the scissor arrangement of the present invention showing the top edge of the assembled scissor;

FIG. 3 is a side elevation view of the safety scissors of the present invention showing the opposed cutting edges in the closed position with the flat shielded cutting edge within the U-shaped safety shield which has been attached to the opposing cutting edge;

DESCRIPTION OF THE INVENTION

Figure 4:
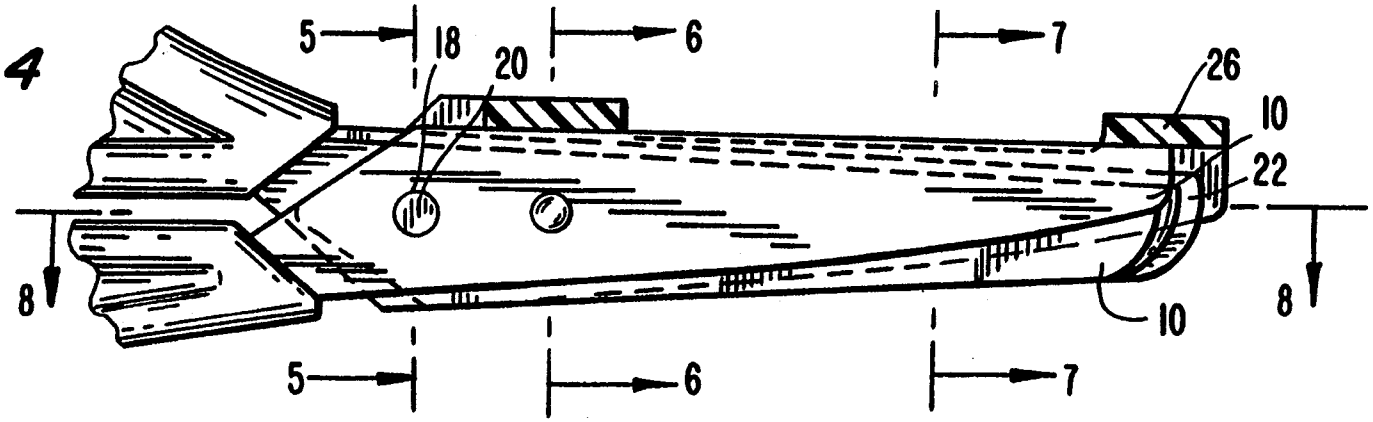
FIG. 4 is a partial elevation section showing the opposing cutting blades in the closed position with part of the U-shaped safety shield removed.

The present invention provides an improved form of safety scissor which prevents potential injury to the user which may result from the insertion of a finger or other body part between the opposing cutting edges thereof, while simultaneously providing a scissor which can be employed in a conventional manner and which allows for the cutting of multiple layers of material, as well as a wide variety of types of materials, including both human hair and synthetic fibrous materials. The safety scissors of the present invention are relatively similar and inexpensive modifications of conventional household scissors and, therefore, may be easily constructed and generally used in the same manner as conventional scissors.

The novel features of the present invention which are considered as defining characteristics are set forth with particularity in the appended claims. Generally speaking, a pair of scissor blades, each having opposed cutting edges and operating handles are provided. These scissor blades are pivotally connected to one another by a pivot means, which may be a fixed pivot means or an adjustable pivot means. One of the pair of scissor blades is provided with a flat shield which is attached to the cutting portion of the said scissor blade and which extends both beyond the cutting edge of said scissor blade and beyond the tip of said scissor blade in a manner which prevents direct contact with that cutting edge or tip. The opposing blade of the pair of scissors is provided with an elongated shield which is generally U-shaped in cross section and which is sufficiently long to cover both the cutting edge of the said opposing scissor blade and the tip thereof. The shield is sufficiently long to extend beyond the tip of the said opposing scissor blade and is affixed by attaching one interior surface formed by the U-shaped cross section to the adjacent surface of the said opposing scissor blade so that, after attachment, the elongated shield-scissor blade combination forms a U-shaped channel having a remaining opening within the channel sufficient to accommodate the first opposing scissor blade, as well as its affixed shield.

In operation, therefore, after assembly of the aforesaid flat shield to the one opposing scissor blade and the aforesaid elongated U-shaped shield to the opposing scissor blade and after pivotally connecting the two opposing blades, the combined safety scissor device of the present invention will operate in the same manner as a conventional scissor wherein, in the closed position, the one opposing scissor blade having the flat shield attached thereto will fit snugly within the elongated U-shaped channel formed by the shield surrounding the opposing scissor cutting blade, with both scissor cutting blades in close proximity.

The construction and obvious advantages of the present invention will best be understood from the following description of a specific embodiment when read in conjunction with the accompanying drawings.

While the following description is detailed and exact to enable one skilled in the art to practice the present invention, it will be understood that the physical embodiments disclosed herein merely serve to exemplify the invention which may be embodied in other specific structures and that the scope of the invention is defined in the claims appended hereto.

As can be seen from in FIG. 1, a pair of scissor blades 10 is provided. Each of the pair of scissor blades 10 includes a cutting edge 12 and an operating handle 14 Substantially in the middle of the pair of scissor blades 10 between the cutting edges 12 and the operating handles 14 is a pivot point 16 formed by an opening 18 through which a pivot means 20 is inserted. The scissor blades 10 rotate about the pivot means 20 causing a pivoting relationship between the opposing scissor blades 10.

Affixed to the outer surface of one opposing cutting blade 10 is a flat shield 22, which flat shield extends beyond the cutting edge 12 of said cutting blade 10 and beyond the tip 24 of said cutting blade 10.

Attached to the outer surface of the other opposing cutting blade 10 is a generally elongated shield 26 having a generally U-shaped cross section 28.

With reference to FIG. 2, a top view of the safety scissors of the present invention is depicted showing the top surface of the U-shaped elongated shield 26 wherein a part of the shield defining a section of one corner outer edge of the elongated portion thereof is cut out to form an opening 28 such that the opposing cutting blade 10 with its affixed flat shield 22 is visible through said opening 28 in the elongated U-shaped shield 26.

With reference to FIG. 3, a side elevation of the safety scissors of the present invention is depicted showing one surface of the elongated U-shaped safety shield 26 in proximity with its affixed cutting blade 10. The opposing cutting blade 10 is shown with its affixed flat shield 22, with the scissors in the closed position.

With reference to FIG. 4, a partial side elevation section of the blade portion of the safety scissor arrangement of the present invention is depicted showing the scissor blades 10, pivot opening 18 and pivot means 20. The top edge of one opposing cutting blade 10 is shown with part of the generally elongated U-shaped shield 26 in place. The other opposing cutting blade 10 is shown with the flat shield 22 visible and extending beyond the tip of said cutting blade, with the opposing cutting blades in the closed position.

Figure 7:
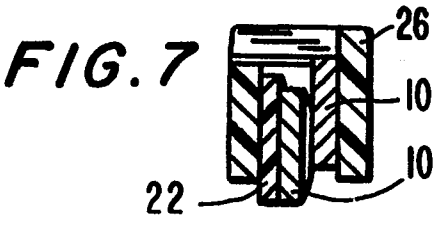
FIG. 7 is yet another cross-sectional view of the safety scissor arrangement of the present invention taken in another position.
Figure 6:
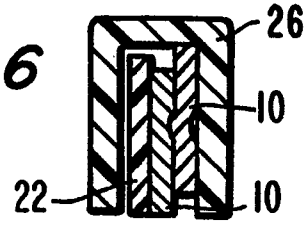
FIG. 6 is another cross-sectional view of the safety scissor arrangement of the present invention similar to FIG. 5 taken in a different position.
Figure 5:
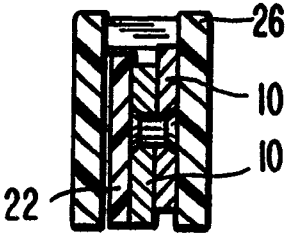
FIG. 5 is a cross-section of the safety scissors of the present invention illustrating the configuration of the one opposing scissor blade with the U-shaped safety shield attached thereto in place and the other opposing scissor blade with the flat shield attached thereto in place.

FIGS. 5, 6 and 7 depict cross-sections of the safety scissors of the present invention taken at various points along the longitudinal axis and showing the relative dispositions of the opposing cutting blades 10, the flat shield 22 and the generally U-shaped shield 26, all in the closed position.

Figure 8:
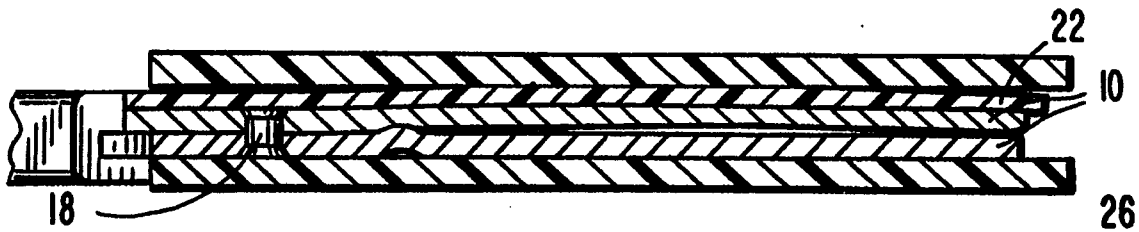
FIG. 8 is a longitudinal sectional view of the combined safety scissor arrangement of the present invention showing a length-wise prospective of the opposing scissor blades with their respective shields in place in the closed position.

FIG. 8 depicts a cross-sectional view taken through the longitudinal axis of the safety scissors of the present invention which again shows the relationship of the opposing cutting blades 10, the flat shield 22 and the generally U-shaped shield 26, as well as the location of the pivot point 18, in the closed position.

The specific form of the pivot means utilized is not critical in defining the scissors encompassed by the present invention and such may be any suitable pivot means including, as shown in FIG. 1, a screw 30, washer 31 and nut 32 arrangement or a pressed rivet 19 type closure or any other suitable means which would serve to accomplish the purpose of allowing the opposing scissor blades to pivot freely as they would in any conventional pair of scissors. Likewise, the actual configuration and materials of construction of the operating handles which are provided as part of the scissors of the present invention are not critical and may be of any conventional design and material which would serve to permit the comfortable operation of the scissors in the usual manner as one would employ any conventional scissors.

Generally speaking, the materials of construction and specific dimensions of the opposing scissor blades and their respective shields are also not critical in defining the present invention as long as the material of construction of the opposing scissor blades are of sufficient quality and durability to accomplish the cutting task for which the scissors are to be used. Therefore, the opposing cutting blades may be formed out of any suitable rigid material, such as, for example, steel, stainless steel, plastic, reinforced plastic or the like. Each such opposing cutting blade will generally be provided with an edge which, when such comes in contact with the edge on the other opposing blade, will serve to allow a smooth cutting action.

The material of construction of the flat shield affixed to the one opposing cutting blade, as well as that of the generally U-shaped shield attached to the other opposing blade, is also not critical so long as this material is sufficiently rigid to function as intended and is of such durability as to avoid its easy fracture or disintegration in the normal use for which the scissors is intended.

The thickness of the respective flat shield and generally U-shaped shield and their particular dimensions will be primarily determined by the use to which the scissors are to be put, as well as the overall dimensions of the opposing cutting blades. The only important dimensional limitation is that the flat shield and the generally U-shaped shield which are attached to the outer surfaces of the opposing cutting blades in the manner depicted in FIGS. 1–8, should be such that each shield should extend a suitable distance beyond the cutting edges and the tips of the respective opposing cutting blades to which they are attached.

According to the invention the flat shield 22 and the U-shaped shield 26 can be attached to the outer surfaces of the opposed cutting blades 10 by any suitable adherent means, technique, or material. For example, any suitable epoxy or cyano-based adhesive could be used. Moreover, the shields could be affixed by a mechanical means such as a clip or staple or by heat treatment or sonic welding. In a preferred arrangement the parts are "heat-staked", i.e., two or more small, preferably cylindrical members extending normal to the planar surface of a shield are received in cooperating holes in the blades and then the distal portions of the cylindrical members are sealed, e.g., by heat or ultrasound, in the holes.

A distance of from about an $\frac{1}{8}$ to about $\frac{1}{4}$ of an inch of extension beyond the cutting edge of the respective opposing cutting blades has been found to be affective in preventing a user from coming in contact with the cutting edges of the opposing cutting blades. The thickness of each shield which extend beyond the cutting edges and tips of the respective cutting blades should be a minimum thickness to prevent the exposed edges of the shields from themselves acting as a cutting edge. That is to day, the thickness of the edges of the shield should be a minimum thickness of approximately $\frac{1}{8}$ of an inch, or more, and should be constructed in such a manner that the said edges are dull to the touch and themselves have no sharp edges or ridges which might otherwise serve to cut or damage a tender young finger or other body part.

As can be understood by one skilled in this art the invention defined herein above may be embodied in many specific forms without departing from the spirit or essential characteristics thereof. The present embodiments are, therefore, to be considered in all respects as illustrative and not restricted. The scope of the invention is to be taken as defined by the appended claims rather than by the foregoing description and all changes which come within meaning of the range of the equivalents of the claims are, therefore, intended to be embraced therein.

I claim:

1. A safety scissor comprising:

first and second scissor blades, each having an inner surface and an outer surface together defining a cutting edge, and each having a tip at a first end and an operating handle at a second end;

pivot means for pivotally connecting said first and second scissor blades together such that their inner surfaces are adjacent and such that their cutting edges are opposed, said pivot means being located between the opposed cutting edges and the operating handles of said first and second scissor blades;

a flat shield member which is attached to the outer surface of said first scissor blade, which flat shield member extends beyond the cutting edge of said first scissor blade in the direction of said cutting edge and beyond the tip of said first scissor blade in the direction of said tip;

a generally U-shaped elongated shield which is attached to the outer surface of said second scissor blade such that said second scissor blade is fixedly situated within the generally U-shaped elongated shield, and which is of sufficient dimensions to extend beyond the cutting edge of said second scissor blade in the direction of said cutting edge and beyond the tip of said second scissor blade in the direction of said tip;

such that the generally U-shaped elongated shield has an elongated opening alongside said fixedly situated second scissor blade, the width of which opening is sufficient to accommodate the inclusion of said first scissor blade as well as its attached flat shield member.

2. A safety scissor according to claim 1, wherein the flat shield member attached to said first scissor blade extends beyond both the cutting edge and the tip of said first scissor blade by approximately $\frac{1}{8}$ of an inch or more.

3. A safety scissor according to claim 1, wherein the generally U-shaped elongated shield attached to said second scissor blade extends beyond both the cutting edge and the tip of said second scissor blade by approximately $\frac{1}{8}$ of an inch or more.

4. A safety scissor according to claim 1, wherein the opposing scissor blades are pivotally connected by a fixed pivot means comprising a screw, washer and nut arrangement.

5. A safety scissor according to claim 1, wherein the opposing scissor blades are pivotally connected by a fixed pivot means comprising a rivet.

6. A safety scissor according to claim 1, wherein the opposing cutting blades are constructed of steel and the respective safety shields are constructed of reinforced plastic.

7. A safety scissor according to claim 1, wherein the flat shield member and the generally U-shaped elongated shield each have an exposed edge that extends beyond the cutting edge of its respectively attached scissor blade in the direction of said cutting edge, such that the exposed edges of the respective shields are free from sharp ridges or protuberances which might cause injury to a user.

8. A safety scissor according to claim 1, wherein the generally U-shaped elongated shield attached to the said second scissor blade is provided with a cut out section along one edge of the U-shaped shield.

* * * * *